US008582863B2

(12) United States Patent
Van Den Brink

(10) Patent No.: US 8,582,863 B2
(45) Date of Patent: Nov. 12, 2013

(54) WINDING DEVICE AND ASSEMBLY COMPRISING A WINDING DEVICE

(75) Inventor: Richard Rudolf Theodoor Van Den Brink, The Hague (NL)

(73) Assignee: Global Factories B.V., The Hague (NL)

( * ) Notice: Subject to any disclaimer, the term of this patent is extended or adjusted under 35 U.S.C. 154(b) by 587 days.

(21) Appl. No.: 12/676,997

(22) PCT Filed: Sep. 12, 2008

(86) PCT No.: PCT/NL2008/050599

§ 371 (c)(1),
(2), (4) Date: Mar. 16, 2010

(87) PCT Pub. No.: WO2009/035329

PCT Pub. Date: Mar. 19, 2009

(65) Prior Publication Data

US 2010/0206978 A1 Aug. 19, 2010

(30) Foreign Application Priority Data

Sep. 12, 2007 (NL) ..... 2000854

(51) Int. Cl.
*G06K 9/00* (2006.01)

(52) U.S. Cl.
USPC ..... 382/140; 382/141; 382/142; 382/153

(58) Field of Classification Search
USPC ..... 382/140–142, 153
See application file for complete search history.

(56) References Cited

U.S. PATENT DOCUMENTS

| | | | | |
|---|---|---|---|---|
| 2,984,425 | A | 5/1961 | Thayer | |
| 4,384,687 | A | 5/1983 | Lamoureux | |
| 7,792,349 | B2 * | 9/2010 | Van Den Brink | 382/141 |
| 2005/0211818 | A1 | 9/2005 | Fiedler | |

FOREIGN PATENT DOCUMENTS

| | | | |
|---|---|---|---|
| EP | 1 580 155 | A2 | 9/2005 |
| GB | 1 382 136 | | 1/1975 |
| GB | 2 242 677 | A | 10/1991 |
| WO | 2005/017814 | A1 | 2/2005 |

* cited by examiner

*Primary Examiner* — Sang Kim
(74) *Attorney, Agent, or Firm* — Hoffmann & Baron, LLP

(57) ABSTRACT

A string emanating from a packaging machine is arranged in a slot by means of a feed inlet and placed in a winding shaft (12). This placement is assisted by the use of positioning brushes (4). After the initial introduction, winding up takes place upon rotation of the winding shaft and upon further engagement of the string in the slot (14) in the winding shaft. The winding shaft is provided on a carrying disc (5) and said carrying disc is also arranged so as to be rotatable. During the first stage, the section of the string emanating from the supply path is pulled with constant force. After the string has been separated from the remaining material, the winding is carried out. Subsequently, the rotating shaft with the string, through rotation of the carrying disc, reaches a next position in which pressing the reel and thus adhesion of the reel end moves the winding shaft out of the reel. The reel has already been checked prior to entering the winding device to determine whether it has to be inspected.

13 Claims, 7 Drawing Sheets

Fig 5a
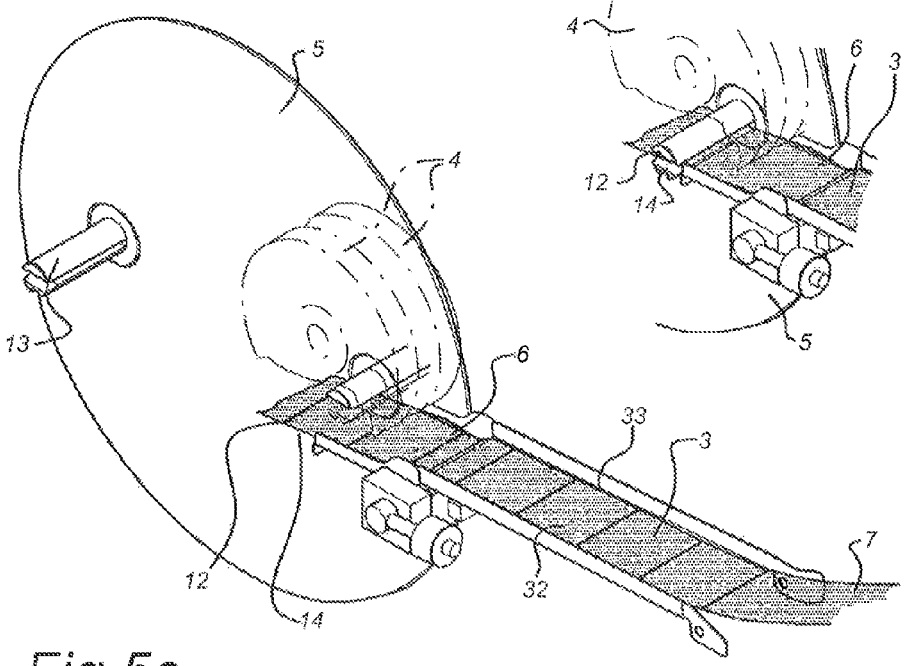
Fig 5b
Fig 5c
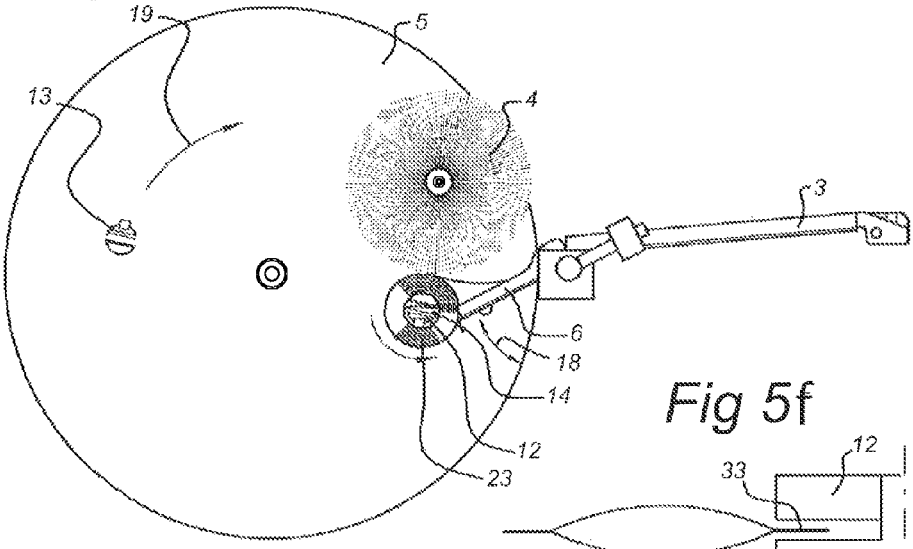
Fig 5f
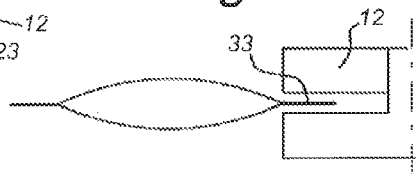

WINDING DEVICE AND ASSEMBLY COMPRISING A WINDING DEVICE

CROSS-REFERENCE TO RELATED APPLICATIONS

This application is the National Stage of International Application No. PCT/NL2008/050599, filed Sep. 12, 2008, which claims the benefit of Netherlands Application No. 2000854, filed Sep. 12, 2007, the contents of which is incorporated by reference herein.

FIELD OF THE INVENTION

The present invention relates to a winding device for winding successive strings of packaging.

A device of this type can be used for winding strings of medicine sachets. However, it should be understood that this device can also be used for other kinds of strings.

BACKGROUND OF THE INVENTION

Strings of medicine sachets comprise sachets which are connected to one another to form a series, each sachet being filled with one or more medicines and each sachet being a daily dose or a dose of the medicines to be taken at a particular time. Such strings are wound up for each patient or group of patients. Packaging is carried out as much as possible in an automated manner and, starting from an endless string or precut string sections, the strings are, if desired, shortened to form string sections after the medicines have been packaged in the strings or string sections and then have to be wound up in order to be able to handle and transport them in a simple manner.

In addition, it is necessary to separate the string sections obtained during packaging into string sections which, upon inspection, have been found to be perfect and string sections which still have to undergo further treatments, such as a further inspection of the medicines and/or a modification thereof.

Until now, the operation of winding up the string sections and separating the reels obtained according to the different diameters has mainly been carried by hand. It is known to wind up a string section by means of a rotating motor provided with a shaft having a slot. Next, an indication of any suitable kind was provided as to whether the packaging had to be further examined. As winding is a relatively simple task and the measures regarding a further inspection are of a greater responsibility, various people were employed in the prior art which further complicated the process.

GB 1,382,136 discloses a winding device for winding textile materials. Therein, a strip of textile material is introduced by hand into the slot of a winding shaft and is subsequently wound onto the latter by means of rotation.

This device is unsuitable for the automatic winding of large numbers of successive string sections which are separated from one another.

SUMMARY OF THE INVENTION

It is an object of the present invention to provide a further improvement to winding strings of packaging which ensures that the winding device can maintain the high speed with which the strings emerge from the packaging machine or other machine. In addition, it is intended to make the process completely automatic.

This object is achieved by means of a device having the features of including, but not limited to, a rotating winding shaft provided with engagement means for strings of packaging, a removal mechanism for removing a wound string from the winding shaft and a discharge path, said rotating winding shaft being rotatably arranged on a carrier said carrier and winding shaft being displaced from a position near a feed to a position near said discharge, characterized in that said feed inlet comprises a feed path which functions as a support for strings and which adjoins the winding shaft.

By means of these measures, it is possible to achieve a particularly high throughput capacity. More particularly, it is possible in this manner, according to a variant of the invention, to place more than one winding shaft in front of the supply path. This means that by using more than one winding shaft, the supply of strings (string sections) of packaging can be processed. This allows more time for each winding operation, as a result of which these can be carried out under more controlled circumstances. Due to the presence of a supply path in the form of a support or carrier, the string sections can be supplied up to the winding shaft in an automated manner, so that it is not necessary to feed the strings of packaging to the winding shaft by hand. This support or carrier may comprise any conceivable structure, such as a conveyor. According to a particular embodiment of this invention, the support or carrier is embodied as a trough and a conveyor is provided upstream thereof which conveys the string sections in the direction of the winding shaft.

Although the displacement of the winding shafts between the feed position and the discharge position can be designed in any conceivable manner, for example by means of a linear displacement, a rotation is preferred. This means that each winding shaft is arranged on a carrier, such as a carrying disc. The axis of rotation of the respective winding shaft is situated at some distance from the axis of rotation of the carrying disc and the winding shaft is moved, preferably during rotation thereof, from the feed position to the discharge position by rotation of the carrying disc.

According to a further particular embodiment of the invention, each winding shaft is provided with engagement means and, more particularly, these engagement means comprise engagement jaws. These engagement jaws can be produced by providing the winding shaft with a slotted aperture. Preferably, the winding shaft is embodied as a stub and the slotted aperture extends up to the free end of the shaft. Preferably, this slotted aperture is only present along part of the path of the string when the string is introduced into/fed through the slot. Subsequently, the winding shaft is moved further into the string when the winding shaft is optionally rotated, i.e. the slot is moved further with respect to the string. Thus, it is possible to achieve complete support of the reel obtained.

When the reel is removed from the winding shaft, the process is reversed. The winding shaft is pushed out of the initial part of the string reel.

It has been found that the string reel is often not fed as a purely horizontal strip on the feed inlet. It may be undulating and it is also possible that the front end thereof is not exactly straight, but that a corner thereof is bent over (dog ears). In that case, measures have to be taken, if the above-described slot provided in the winding shaft, in order to ensure that the front of a reel string section is introduced accurately into the slot.

This can partly be achieved in the above-described manner by moving the winding shaft increasingly into the string section. It has, after all, been found that when the front part of the string section folds over, this folding over (dog ear) mostly takes place on one side. This can be compensated for by introducing the winding shaft into the string section from the other side.

However, this generally does not provide a satisfactory solution in cases where the string section is undulating on the feed inlet. In that case, further measures are preferably taken in order to ensure that the front end of the string section is introduced into the slot in a reliable manner. This can be achieved by means of a wide variety of conical structures. However, according to an advantageous embodiment of the invention, rotating brushes are used for this purpose which guide the front end of a string section into the slot or other engagement means of the winding shaft while rotating. In this case, these brushes are preferably arranged in such a manner that they provide guidance up to and into the slot.

The string generally comprises a large number of sachets and each sachet has a container part consisting of two spaced-apart film/foil material parts between which the medicines are contained and which are connected to one another near the edge region. The resulting edge part is relatively stiff and, according to a particular embodiment of the invention, only the edge part is initially supported by the slot when the string section is introduced into the slot. At a later stage, the entire sachet is supported as the winding shaft moves further in the direction of the centre of the sachets. Of course, the winding shaft only moves in a section of the string which does not contain medicines in order to prevent damage to the medicines.

The present invention also relates to a method for winding a string of packagings, comprising separating a section of said string to be wound from a supply, arranging an end of said string on a winding shaft, winding said string and removing said string from said winding shaft, wherein said winding shaft is subjected to a further displacement, during winding of said string, from a feed position of said string to a discharge position and wherein a further winding shaft is present for accommodating a further string during removal of said reel of said string.

As described above, the string section is separated from the string. This is controlled electronically and according to a particular embodiment of the invention, while this separation has not taken place, the drive of the winding shaft is controlled in such a manner that the string section to be wound up is always subjected to a slight tensile force which is just sufficient to wind up the string section correctly. Once the string section has been separated from the remainder of the string, the motor of the winding shaft can rotate at a higher speed.

It will be understood that reels of a greatly varying length of the string section can be wound in succession with the device according to the present application.

According to a further particular embodiment of the invention, a camera or another read unit is present at the cutting station and preferably in front of the reels, viewed in the direction of travel, which determines the position of the respective string section. Preferably, a code will be present on each subpackaging in the string section which is recognized by the camera. This enables the camera to determine the cutting instant. This camera can also determine which string section should be subjected to a closer inspection after it has been formed into a reel and which string section can immediately be processed further. To this end, a flap is provided near the discharge outlet which sends the resultant reels to the respective discharge outlet.

The present invention also relates to a reel-pressing element which is arranged near said discharge outlet.

After the contents of the strings of medicine sachets have been inspected in any suitable way, the volume of the string will be reduced in any suitable way. This can be carried out in the above-described manner by winding, but it is also possible to fit the strings together into an outer packaging by means of folding (zigzag) or in any other conceivable way. With the assembly according to the invention, when a mistake is found during the inspection, the string in question is not immediately disposed of, but only after winding/folding thereof by means of the downstream winding/folding device has taken place. In this manner, it is possible to carry out the inspection at a central location. As it has been found that in a number of cases the device for inspecting has incorrectly rejected strings (e.g. due to problems with visual techniques) an operator can, after he/she has found this to be the case, simply pass the string in question to the discharge position where it will be conveyed further.

BRIEF DESCRIPTION OF THE DRAWINGS

The invention will be explained in more detail below with reference to an exemplary embodiment illustrated in the drawings, in which:

FIGS. 5*a-f* show the various stages of winding a string section, and

DETAILED DESCRIPTION OF THE PREFERRED EMBODIMENTS

Figure 1:
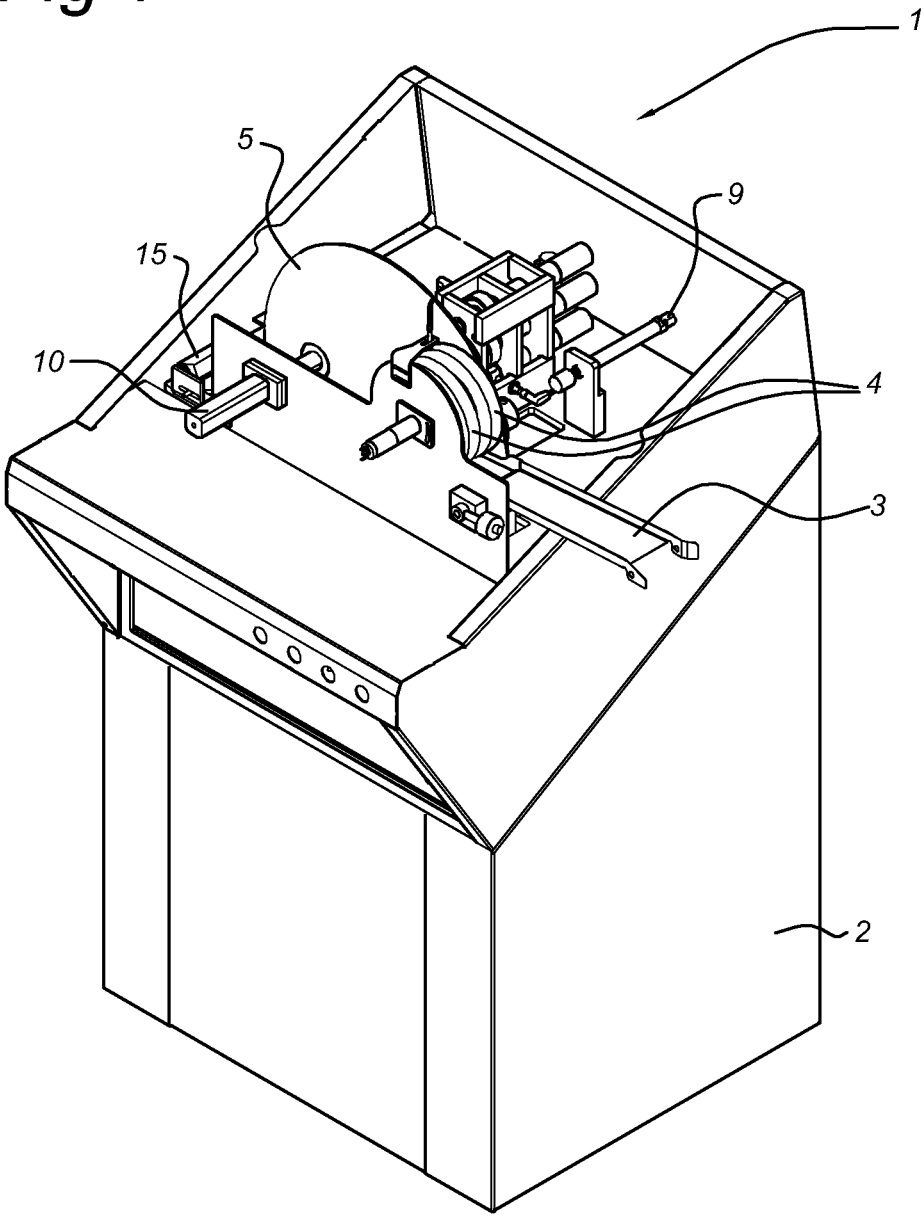
FIG. 1 diagrammatically shows a partially open device according to the invention.
Figure 2:
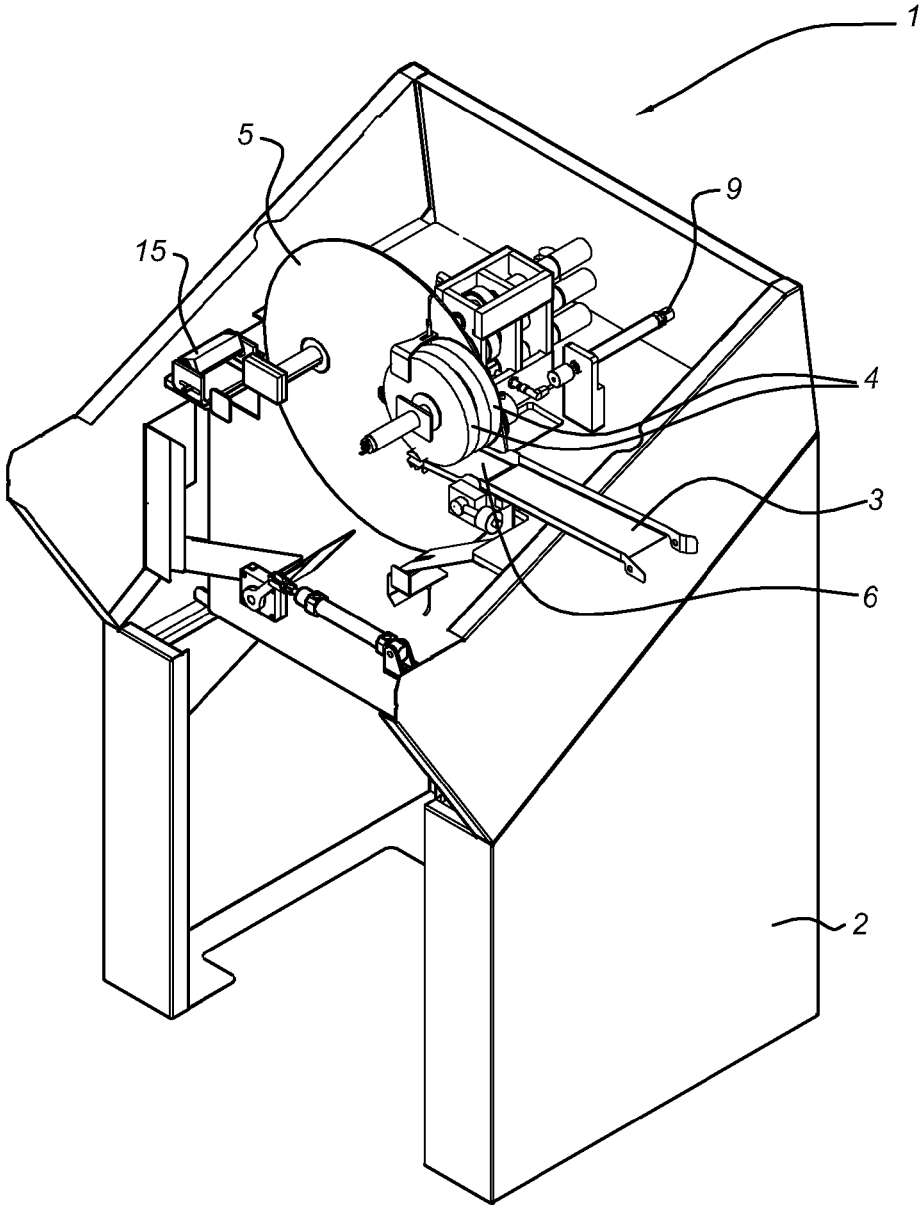
FIG. 2 shows the device from FIG. 1 in a more open position.
Figure 3:
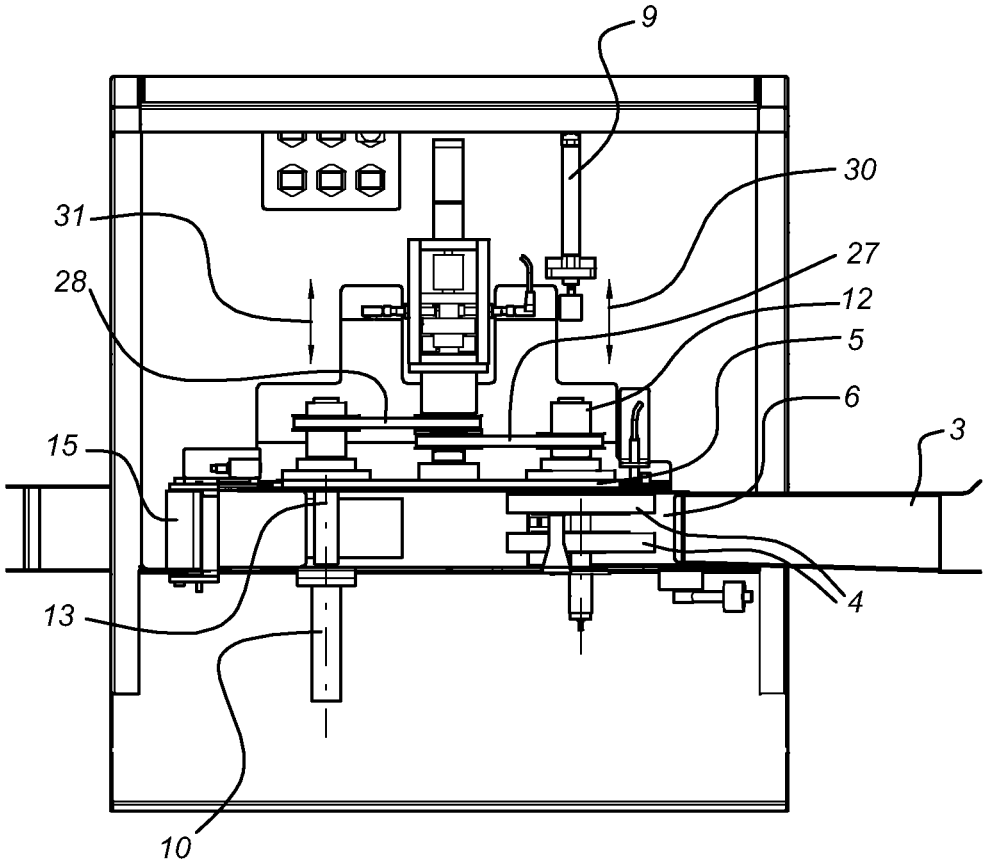
FIG. 3 shows a top view of the device from FIGS. 1 and 2 in an open position.

In FIG. 1, the device according to the present invention is denoted overall by reference numeral 1. It comprises a housing/frame 2 which accommodates various components.

Figure 4:
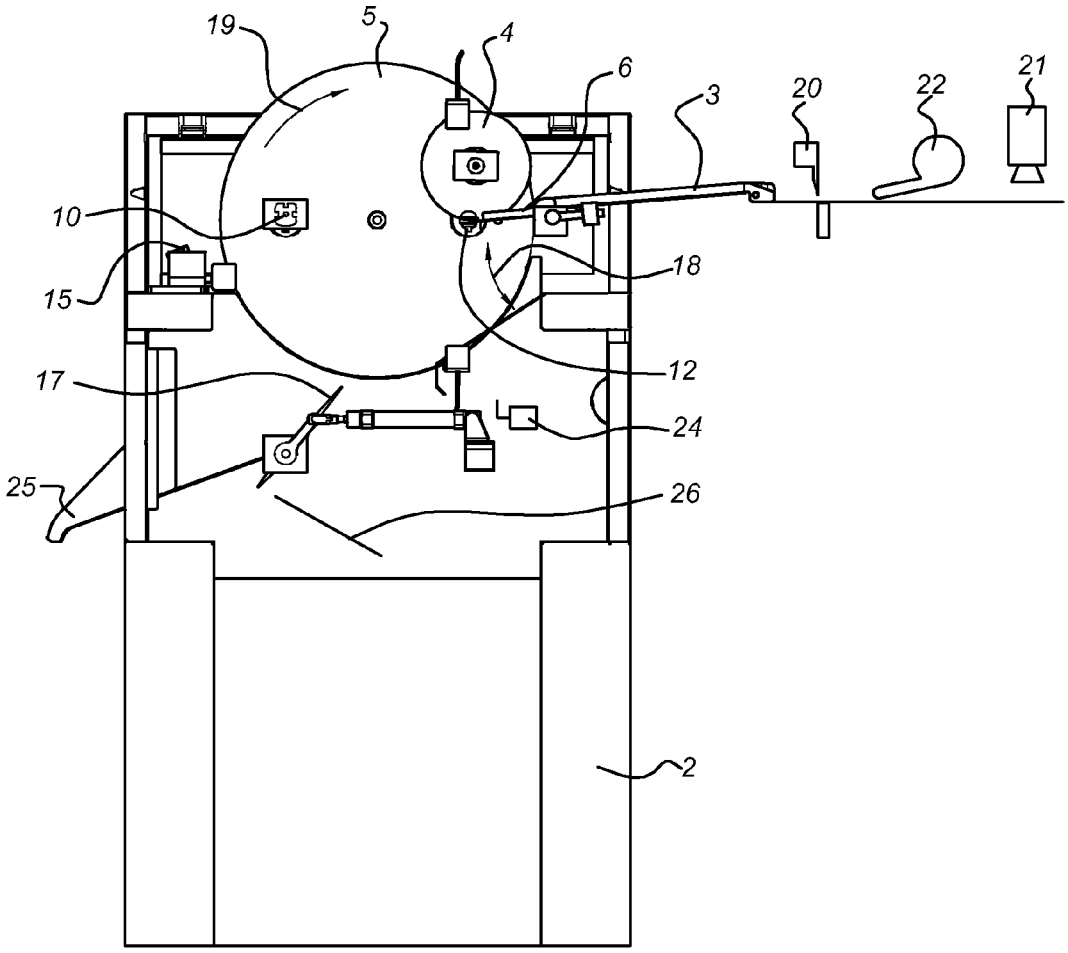
FIG. 4 shows a side view of the device from FIGS. 1-3.

The device according to the present invention can be placed downstream of any kind of other device in a simple manner, for example a packaging device for medicines. Auxiliary stations may be provided between this packaging device and the device 1 according to the present invention. For example reference is made to FIG. 4, which shows that a camera 21 is present which registers the data on the string. In addition, a tape unit 22 is provided by means of which a piece of tape can be provided on the end of a string section to be cut. In addition, reference numeral 20 denotes a cutting device.

Then, a string section ends up on the feed 3 of the device 1 according to the present invention. In the present exemplary embodiment, the feed inlet is shown as a trough. Due to the "propulsion force" exerted by a conveyor (not shown) which is placed upstream of the feed 3, the string is fed to the winding shaft 12 to be described below in an accurately positioned manner. However, it is also possible to embody the feed inlet itself as a conveyor, for example a conveyor belt, driven rolls and/or cords. A string section passes to an inlet track 6 via feed 3. The string section comprises a large number of sachets 32 which are separated from one another by a (seal) edge. The longitudinal edge of the sachets is denoted by reference numeral 33. This longitudinal edge is relatively stiff, due to the two layers of material which are attached to one another. The inlet track is arranged so as to be pivotable. Pivoting takes place in the direction of the arrow 18. Above the inlet track 6, there are two brushes 4 which are spaced apart. When no string section is present, the inlet track presses against the brushes and the contact surface thereof is situated at the slot 14 of the first winding shaft 12. This winding shaft can be rotatably driven by means of a transmission 27 in a way which is not shown in any more detail. In addition, this first winding shaft 12 can be moved to and fro in the direction of arrow 30. The same applies to the second winding shaft 13 which is driven by means of a transmission 28 and can also be moved to and fro in the direction of the arrow 31. The to-and-fro movement is carried out with pneumatic cylinders which are denoted by reference numerals 9 and 10. These pneumatic cylinders are attached to the housing 2 in a stationary manner. This means that these cylinders 9 and 10, respectively, only become active when the first and second winding shaft 12 and 13, respectively, are in a certain discrete position in order to displace the latter.

Rotation of the rotating disc 5 takes place in the direction of arrow 19.

In addition, a pressing element is present, comprising a roll which is pressed in a downward direction with a sprung leaf 15.

A flap 17 is present which can switch between two positions: a first position in which the finished reels are carried away via first discharge outlet 25 and a second position in which these reels are carried away to a second discharge outlet 26. If desired, further positions are possible for certain products. This flap 17 is actuated by means of a control unit 24.

The above-described device operates as follows. Emerging from a packaging machine (not shown in any more detail), for example a packaging machine for packaging medicines, an endless string enters the device 1 via a feed 3. Therein, the properties of the string are observed by the camera 21. After the string has moved over feed 3, the string reaches string the inlet track 6. With the aid of the brushes 4, the front end of the string is held against the upper surface of the inlet track.

In this position, the first winding shaft 12 is only moved into the path of the string over a partial distance.

This is shown in detail in FIGS. 5*a* and 5*f*. This means that the slot 14 only extends across a part of the width of the string. This extension corresponds to the width of the relatively stiff edge 33. Subsequently, the front end of the string is inserted into the slot 14. After a certain amount of the string has moved through the slot, for example approximately one third of a packaging unit, the winding shaft is rotated. The instant of starting the rotation can be determined by means of a time switch in combination with the observations by the camera 21. In addition, it is possible to provide a light harrier which detects the front end of the string. After the initial engagement of the string, the first winding shaft 12 is pushed completely into/over the string by means of the pushing cylinder 9, as is shown in FIG. 5*b*.

Then, the winding shaft starts to rotate at such a speed that a tensile force is exerted on the string which is situated on the feed inlet, which tensile force is sufficient to ensure conveyance thereof. When the reel on the first winding shaft becomes thicker, the free front end of the inlet track 6 moves down arrow 18. In this case, the carrying disc 5 moves in the direction of arrow 19. As a result thereof, the first winding shaft 12 with the increasingly larger reel moves down and inlet track 6 is pushed down further.

During winding, camera 21 detects the intended end of the respective string section. Subsequently, tape is applied in a controlled manner to the respective end of the string section by means of tape station 22 and cutting is carried out at the end of the string section near 20. Immediately after cutting, the drive motor (not shown in any more detail) for the first winding shaft 12 is actuated in such a manner that it rotates at a higher speed in order to wind up the remaining string section more quickly (FIG. 5*c*).

Figure 5D:
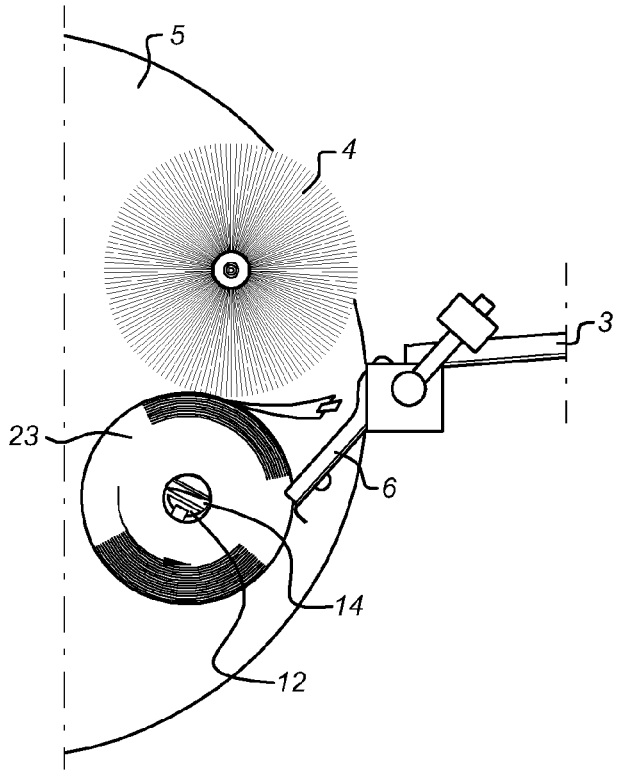

As the reel moved further, the diameter thereof increases, as is illustrated in FIG. 5*d*. The carrying disc 5 continues to rotate, as a result of which the first winding shaft 12 reaches the position drawn for the second winding shaft 13 in FIGS. 1-4. Of course, this means that the second winding shaft 13 takes the position of the first winding shaft and can then wind up a subsequent string section.

Figure 5E:
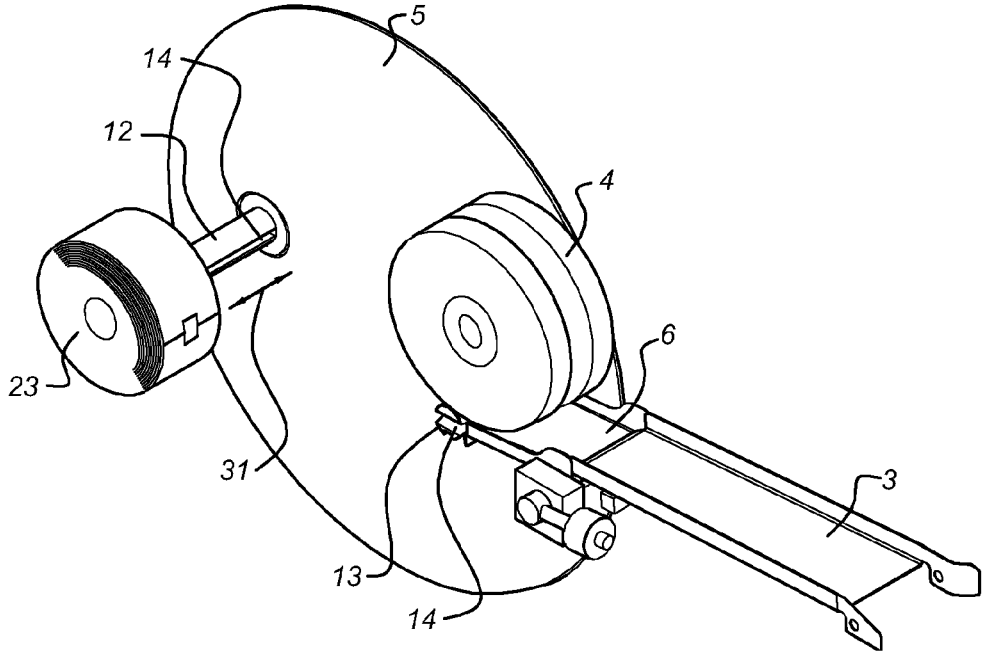

In this final position, the pressure exerts a pressure force on the resulting reel, as a result of which the tape is pressed against the reel and thus ensures good adhesion thereof. Then, the pushing cylinder 10 becomes active and pushes hack the first winding shaft 12 in the direction of arrow 31, as a result of which the reel is released from the slot 14 of the first winding shaft. This is shown in FIG. 5*e*. Subsequently, the reel can fall down freely and is passed to either discharge outlet 25 or discharge outlet 26, controlled by the flap 17.

As has been indicated above, a further string section is meanwhile wound up by means of the second winding shaft.

It will be understood that a particularly high capacity can be achieved in this manner. By winding up the reel faster during the second part of winding, i.e. after separation by means of cutting device 20, this capacity is increased further. In addition, it is possible to provide more than two winding shafts on a carrying disc.

Figure 6:
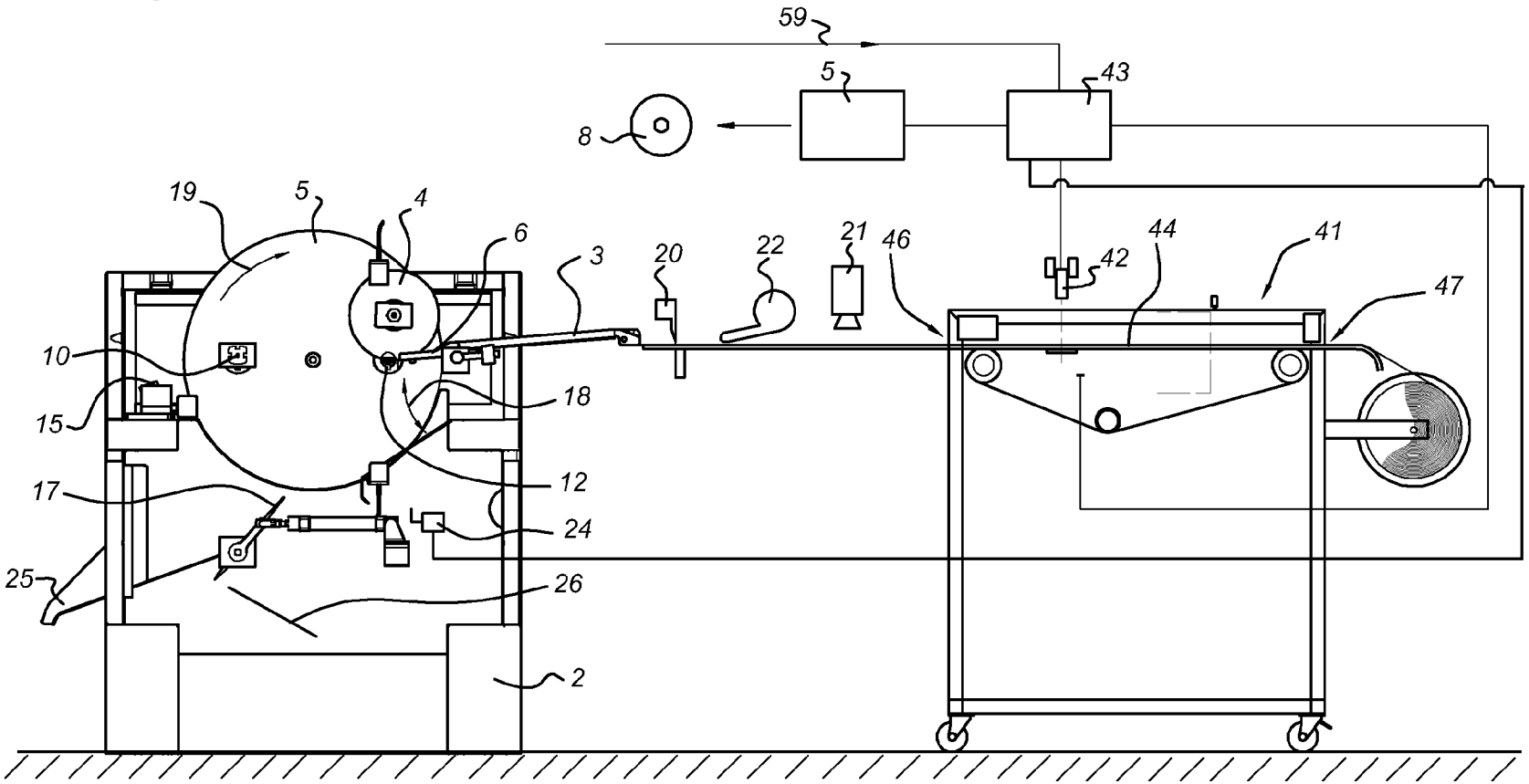
FIG. 6 shows an assembly according to the present invention.

FIG. 6 shows an assembly according to the present invention. This consists of the combination of an above-described device (FIG. 4) and a device, denoted overall by reference numeral 41, for inspecting the contents of a string of medicine packagings. Details of this device can be found in WO 2005/017814. This device 41 is provided with a supply 46 for a string of packagings. The discharge is denoted by reference numeral 47. Conveying is carried out by means of a conveyor 44. Downstream of the supply 46, the string of packaging is subjected to a scanning camera 42 which compares the data obtained with the data which are supplied electrically in another way (denoted by reference numeral 59). This comparison takes place in comparator 43. The data with respect to the contents of the string packaging, patient data (which may, for example, be provided on each string or each sachet of the string by means of a bar code or in another way) can be compared therein.

If an error is detected by comparator 43, a signal is emitted to the control unit 24. Control unit 24 actuates the flap 17 in the manner described above. As a result thereof, it is no longer necessary to provide a discharge station immediately behind the device 41. It is possible to allow discharging by means of the device described with reference to FIG. 4 to take place after winding. This makes the process more efficient and, in addition, the product can immediately be passed to the correct discharge outlet 25 by the operator or another person in the case of a false alarm.

Upon reading the above, those skilled in the art will immediately be able to think of variants of the invention. These are within the scope of the attached claims.

The invention claimed is:

1. A method for winding a string, comprising:

separating a string to be wound from a packaging string supply, arranging an end of said separated string on a first winding shaft, winding said string to a wound string by rotation of said first winding shaft, and removing said wound string from said first winding shaft, wherein said first winding shaft is subjected to a further displacement, during winding of said string, from a feed position to a discharge position and wherein a second winding shaft is present for accommodating a further string during removal of said wound string from said first winding shaft, wherein each of said strings comprises a string of medicine packagings and wherein each of said strings is mechanically supported by a string supporting part of a feed when the end of said string is arranged on the respective winding shaft, wherein said string comprises a series of sachets which are connected to one another, each sachet comprising a container part and an edge part delimiting the container part, in which said winding shaft is provided with a slot for engaging said string, in which said slot substantially only receives the edge part during initial winding and said slot receives the edge part and container part when the winding shaft is moved along further.

2. The method according to claim 1, wherein the winding shaft is first only moved into a path of the string over a partial distance in such a manner that said slot only extends across a part of the width of the string, and wherein a front end of the string is subsequently inserted into the slot, and wherein after a certain amount of the string has moved through the slot, the winding shaft is rotated for initial engagement of the string, and wherein after said initial engagement of the string, the winding shaft is pushed completely over the string.

3. The method according to claim 1, wherein only the edge part is initially supported by the slot when the string is introduced into the slot, and wherein, at a later stage, the entire sachet is supported as the winding shaft moves further in the direction of the center of the sachets.

4. The method according to claim 1, wherein the string of medicine packagings contains medicines, and wherein the slot of the winding shaft only moves over a section of the string which does not contain medicines in order to prevent damage to the medicines.

5. An assembly comprising:

a first device for inspecting a string of connected medicine packagings containing medicines, the first device comprising a supply, means for conveying said string of connected medicine packagings, a camera for inspecting the medicines in said string of connected medicine packagings, a discharge for said string of connected medicine packagings and an input for patient and medicine data, as well as a comparator device for comparing said patient and medicine data by means of said camera, a second device, which adjoins said discharge, for winding said string of connected medicine packagings for packaging the latter, wherein a control unit is present which controls a control flap, provided in a discharge of said second device, by means of error signals originating from said first device, for discharging said string of connected medicine packagings to a first or second discharge position thereof.

6. An assembly according to claim 5, wherein said second device comprises:

a feed for feeding said string of connected medicine packagings, a rotatable winding shaft provided with engagement means for engaging said string of connected medicine packagings fed by said feed, said winding shaft being rotatable for winding said string of connected medicine packagings to a wound string, a removal mechanism for removing the wound string from the winding shaft, and a discharge for discharging said wound string that has been removed from the winding shaft, said winding shaft being rotatably arranged on a carrier, said carrier and winding shaft being displaceable from a position near said feed to a position near said discharge, wherein said feed comprises a string support providing a feed path for said string of connected medicine packagings to the winding shaft.

7. The device according to claim 6, wherein the carrier comprises a carrying disc having an axis of rotation, and wherein the winding shaft has an axis of rotation which is situated at a distance from said axis of rotation of the carrying disc, and wherein the winding shaft is displaceable from the position near the feed to the position near the discharge by rotation of the carrying disc.

8. An assembly according to claim 6, wherein said string support comprises a trough.

9. The device according to claim 6, wherein a brush acting on the winding shaft near the feed path is present.

10. The device according to claim 6, wherein said engagement means comprise a slot provided in the winding shaft, said winding shaft being movable for engaging said string of connected medicine packagings and releasing said wound string, respectively.

11. The device according to claim 6, wherein control means for said string of connected medicine packagings are provided for interacting with the engagement means.

12. The device according to claim 11, wherein said control means comprise rotating brushes.

13. The device according to claim 12, wherein said rotating brushes are provided in such a manner that said string of connected medicine packagings is subjected to a displacement movement with respect to said engagement means by means of said rotating brushes for guiding a front end of said string of connected medicine packagings to said engagement means.

* * * * *